US008979504B2

(12) United States Patent
Snider et al.

(10) Patent No.: US 8,979,504 B2
(45) Date of Patent: Mar. 17, 2015

(54) MAGNETIC DRIVE PUMP ASSEMBLY WITH INTEGRATED MOTOR

(75) Inventors: Lee Snider, Christiansburg, VA (US); Moe K. Barani, Radford, VA (US); Troy Anderson, Blacksburg, VA (US); Ronald Flanary, Blacksburg, VA (US)

(73) Assignee: Moog Inc., East Aurora, NY (US)

( * ) Notice: Subject to any disclaimer, the term of this patent is extended or adjusted under 35 U.S.C. 154(b) by 273 days.

(21) Appl. No.: 12/859,742

(22) Filed: Aug. 19, 2010

(65) Prior Publication Data

US 2011/0171048 A1 Jul. 14, 2011

Related U.S. Application Data

(60) Provisional application No. 61/235,274, filed on Aug. 19, 2009.

(51) Int. Cl.

| | |
|---|---|
| ***F04B 43/12*** | (2006.01) |
| ***F04B 49/06*** | (2006.01) |
| ***F04B 17/00*** | (2006.01) |
| ***F04B 35/04*** | (2006.01) |
| ***F04D 29/02*** | (2006.01) |
| ***F04D 29/42*** | (2006.01) |
| ***F04D 29/62*** | (2006.01) |
| ***F04D 13/06*** | (2006.01) |

(52) U.S. Cl.

CPC ..... *F04D 29/026* (2013.01); *F04D 29/426* (2013.01); *F04D 29/628* (2013.01); *F04D 13/0633* (2013.01); *F04D 13/064* (2013.01)

USPC ... 417/53; 417/423.1; 417/423.7; 417/423.11

(58) Field of Classification Search

CPC ... F04D 13/064; F04D 29/628; F04D 29/426; F04D 13/0633; F04D 29/026

USPC ..... 417/423.1, 423.11, 423.12, 423.7, 417/423.53, 53

See application file for complete search history.

(56) References Cited

U.S. PATENT DOCUMENTS 2,649,048 A * 8/1953 Pezzillo et al. ..... 417/357
4,762,461 A * 8/1988 Ushikoshi ..... 415/14

(Continued)

FOREIGN PATENT DOCUMENTS

JP 61178595 A 11/1986
JP 8214475 8/1996

(Continued)

OTHER PUBLICATIONS

Micropump, Inc.; "Electronic Cooling Market;" Dec. 2005; pp. 1-2; Germany.

*Primary Examiner* — Charles Freay
*Assistant Examiner* — Lilya Pekarskaya
(74) *Attorney, Agent, or Firm* — Hodgson Russ LLP

(57) ABSTRACT

Embodiments of the invention provide a pump assembly and a method for assembly the pump assembly. The pump assembly includes a stator assembly, a lower pump housing, an upper pump housing, a rotor assembly, and an isolation cup. The method includes coupling the stator assembly to the lower pump housing, overmolding an overmold material over the stator assembly and the lower pump housing, positioning the isolation cup over the overmold, and positioning the rotor assembly inside the isolation cup. The method further includes placing the upper pump housing over the rotor assembly and coupling the upper pump housing to the lower pump housing.

20 Claims, 12 Drawing Sheets

(56) References Cited

U.S. PATENT DOCUMENTS

| | | | | |
|---|---|---|---|---|
| 4,973,231 | A | 11/1990 | Colliver | |
| 4,998,863 | A * | 3/1991 | Klaus | 417/63 |
| 5,385,454 | A * | 1/1995 | Kobayashi et al. | 417/423.12 |
| 5,407,331 | A | 4/1995 | Atsumi | |
| 5,588,392 | A * | 12/1996 | Bailey | 114/357 |
| 5,692,886 | A * | 12/1997 | Kobayashi et al. | 417/423.12 |
| 5,694,268 | A * | 12/1997 | Dunfield et al. | 360/98.07 |
| 5,785,013 | A | 7/1998 | Sinn et al. | |
| 6,034,465 | A * | 3/2000 | McKee et al. | 310/268 |
| 6,036,456 | A * | 3/2000 | Peters et al. | 417/423.3 |
| 6,048,168 | A * | 4/2000 | Sabini | 415/111 |
| 6,082,974 | A | 7/2000 | Takemoto et al. | |
| 6,264,440 | B1 | 7/2001 | Klein et al. | |
| 6,293,772 | B1 * | 9/2001 | Brown et al. | 417/420 |
| 6,363,918 | B2 | 4/2002 | Hakansson et al. | |
| 6,524,083 | B2 | 2/2003 | Deai et al. | |
| 6,554,576 | B2 | 4/2003 | Rennett et al. | |
| 6,702,555 | B2 | 3/2004 | Allen et al. | |
| 6,808,371 | B2 | 10/2004 | Niwatsukino et al. | |
| 6,835,051 | B2 | 12/2004 | Heim et al. | |
| 6,903,475 | B2 * | 6/2005 | Ortt et al. | 310/154.07 |
| 6,986,647 | B2 * | 1/2006 | Jones et al. | 417/357 |
| 7,021,905 | B2 | 4/2006 | Torrey et al. | |
| 7,101,158 | B2 | 9/2006 | Hembree et al. | |
| 7,119,469 | B2 * | 10/2006 | Ortt et al. | 310/154.08 |
| 7,146,822 | B2 | 12/2006 | Stewart | |
| 7,232,292 | B2 | 6/2007 | Lopatinsky et al. | |
| 7,371,056 | B2 | 5/2008 | Ito et al. | |
| 7,394,174 | B2 * | 7/2008 | Blase et al. | 310/43 |
| 7,473,075 | B2 | 1/2009 | Huang et al. | |
| 7,939,975 | B2 * | 5/2011 | Saga et al. | 310/43 |
| 2004/0070289 | A1 * | 4/2004 | Worden et al. | 310/43 |
| 2006/0034717 | A1 * | 2/2006 | Castellone et al. | 417/423.14 |
| 2006/0057006 | A1 * | 3/2006 | Williams et al. | 417/423.14 |
| 2006/0245956 | A1 * | 11/2006 | Lacroix et al. | 417/423.1 |
| 2007/0039719 | A1 | 2/2007 | Eriksen | |
| 2007/0090704 | A1 | 4/2007 | Chen | |
| 2008/0031748 | A1 * | 2/2008 | Ihle et al. | 417/321 |
| 2008/0159884 | A1 | 7/2008 | Nakanishi et al. | |
| 2008/0159885 | A1 | 7/2008 | Kameya et al. | |
| 2008/0260515 | A1 | 10/2008 | Anami et al. | |
| 2008/0289803 | A1 | 11/2008 | Yang et al. | |
| 2009/0010769 | A1 | 1/2009 | Laufer et al. | |
| 2009/0081059 | A1 * | 3/2009 | Seki et al. | 417/420 |
| 2010/0054971 | A1 * | 3/2010 | Li et al. | 417/423.7 |
| 2010/0054972 | A1 * | 3/2010 | Li et al. | 417/423.7 |
| 2010/0130343 | A1 * | 5/2010 | Nagasaka et al. | 501/88 |
| 2011/0120073 | A1 * | 5/2011 | Flanary | 56/250 |
| 2012/0019080 | A1 * | 1/2012 | Kottmyer et al. | 310/43 |
| 2012/0020820 | A1 * | 1/2012 | Francini | 417/410.4 |

FOREIGN PATENT DOCUMENTS

| | | |
|---|---|---|
| JP | 2002155883 A | 5/2002 |
| JP | 2007009787 | 1/2007 |

* cited by examiner

FIG. 13
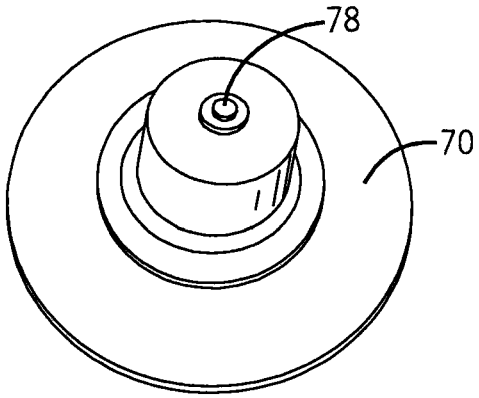
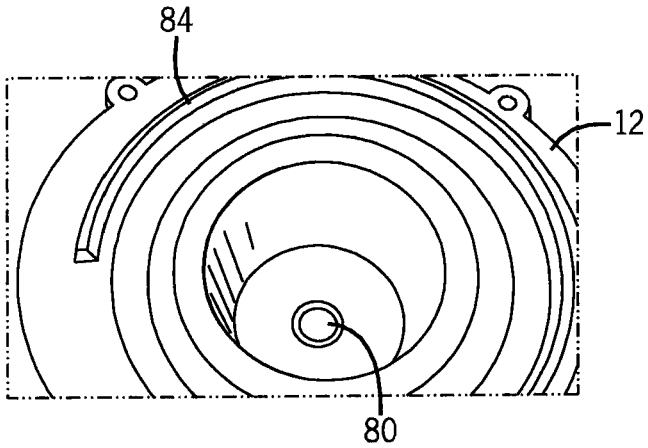
FIG. 14A
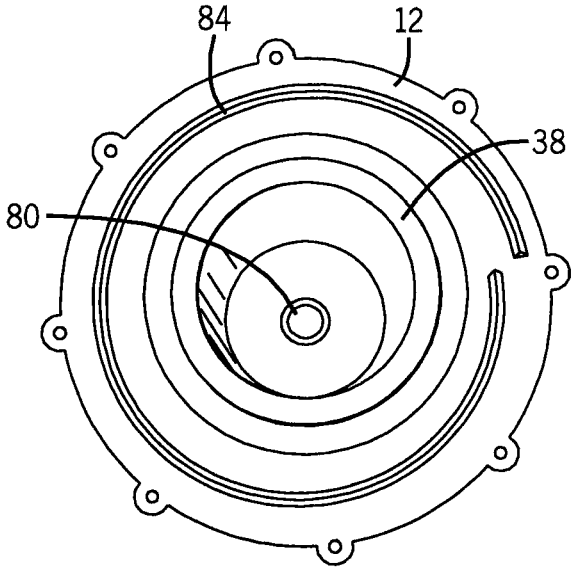
FIG. 14B

MAGNETIC DRIVE PUMP ASSEMBLY WITH INTEGRATED MOTOR

RELATED APPLICATIONS

This application claims priority under 35 U.S.C. §119 to U.S. Provisional Patent Application No. 61/235,274 filed on Aug. 19, 2009, the entire contents of which is incorporated herein by reference.

BACKGROUND

Cooling of computer systems has conventionally been accomplished through forced-air cooling systems, such as fans. However, liquid cooling systems provide better heat transfer compared to forced-air systems. In liquid cooling systems, a liquid coolant circulates through tubing around the computer system. As the liquid coolant circulates, heat is transferred from the computer system to the liquid coolant, thus cooling the computer system. The liquid coolant then circulates back to a cooling component where it is again cooled, and then recirculated around the computer system. Circulation of the liquid coolant can be accomplished using a pump. Conventional pumps for liquid cooling systems utilize drive magnets. Most magnetic drive pumps require a separate motor and can be bulky, making them a poor choice for use in small spaces near computer systems.

SUMMARY

Some embodiments of the invention provide a pump assembly for pumping a fluid. The pump assembly includes a first pump housing, a second pump housing removably coupled to the first pump housing, and a motor assembly with a rotor assembly and a stator assembly. The stator assembly is positioned inside the first pump housing, and the pump assembly also includes an overmold substantially covering the stator assembly and an inside portion of the first pump housing. The pump assembly further includes an isolation cup positioned inside the first pump housing over the overmold. The isolation cup is coupled to the first pump housing and the rotor assembly is positioned inside the isolation cup.

Some embodiments provide a method of assembling a pump assembly. The method includes coupling a stator assembly to a lower pump housing. The method also includes overmolding an overmold material over an inside portion of the stator assembly and an inside portion of the lower pump housing, positioning an isolation cup inside the lower pump housing over the overmold material, and positioning the rotor assembly at least partially inside the isolation cup. The method further includes securing a position of the rotor assembly by placing an upper pump housing over the rotor assembly and coupling the upper pump housing to the lower pump housing.

Some embodiments of the invention provide a pump assembly including a first pump housing with an inlet and an outlet, and a second pump housing removably coupled to the first pump housing. The pump assembly also includes a pumping chamber fluidly connecting the inlet and the outlet, a motor chamber in fluid communication with the pumping chamber, and a stator assembly positioned in the second pump housing. The pump assembly further includes an overmold substantially covering the stator assembly and an inside portion of the second pump housing. The overmold substantially seals the stator assembly from fluid passing through the motor chamber and the pumping chamber.

DESCRIPTION OF THE DRAWINGS

FIG. 13 is a perspective view of a mold insert used during the assembly process of FIG. 9.

FIG. 14A is an inside view of a pump housing and a stator assembly during the assembly process of FIG. 9.

FIG. 14B is another inside view of a pump housing and a stator assembly during the assembly process of FIG. 9.

DETAILED DESCRIPTION

Figure 1:
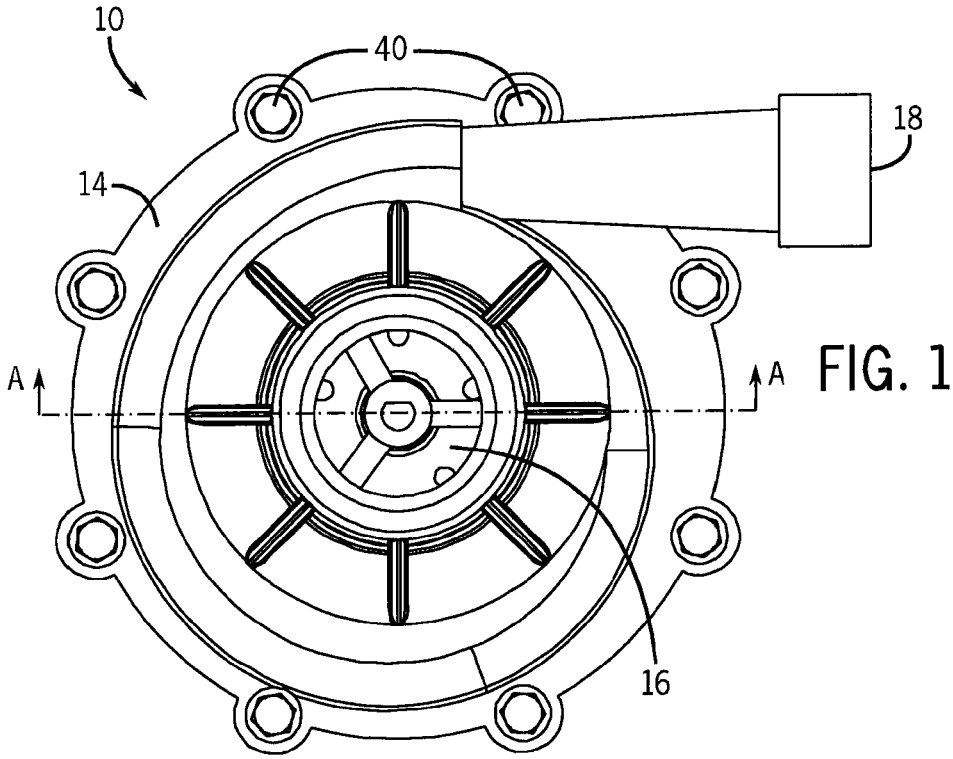
FIG. 1 is a front view of a pump assembly according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings, whether mechanical or electrical. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 2:
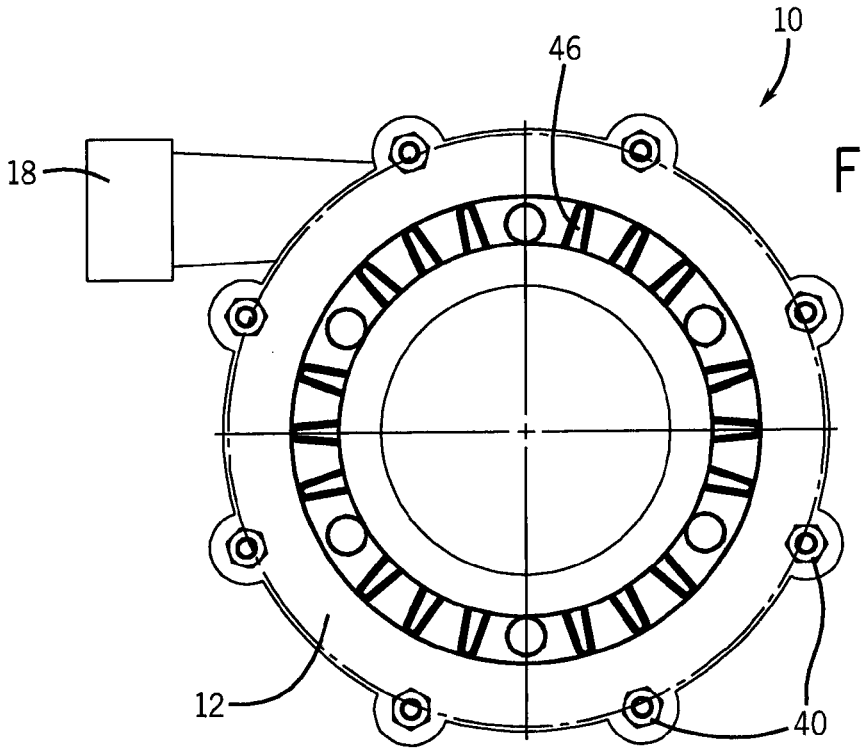
FIG. 2 is a back view of the pump assembly of FIG. 1.
Figure 3:
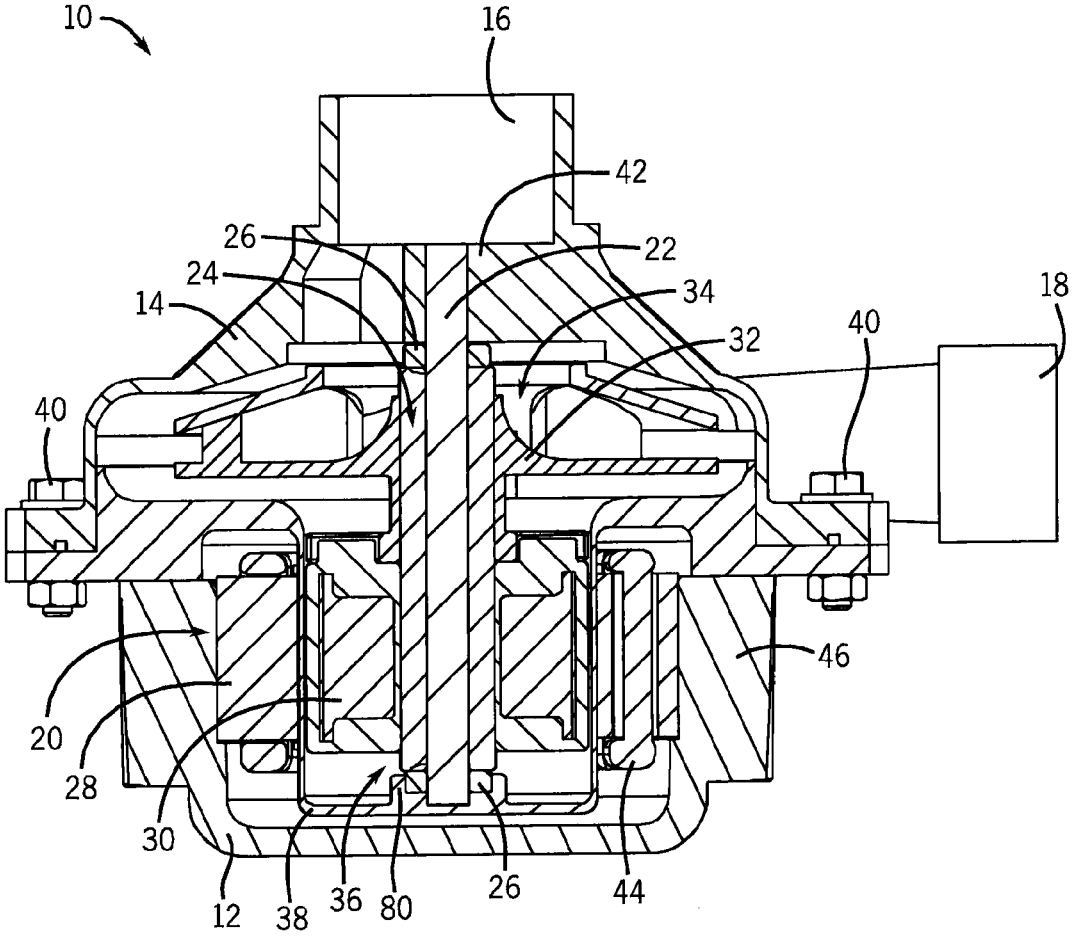
FIG. 3 is a cross-sectional view of the pump assembly taken along line A-A of FIG. 1.
Figure 4:
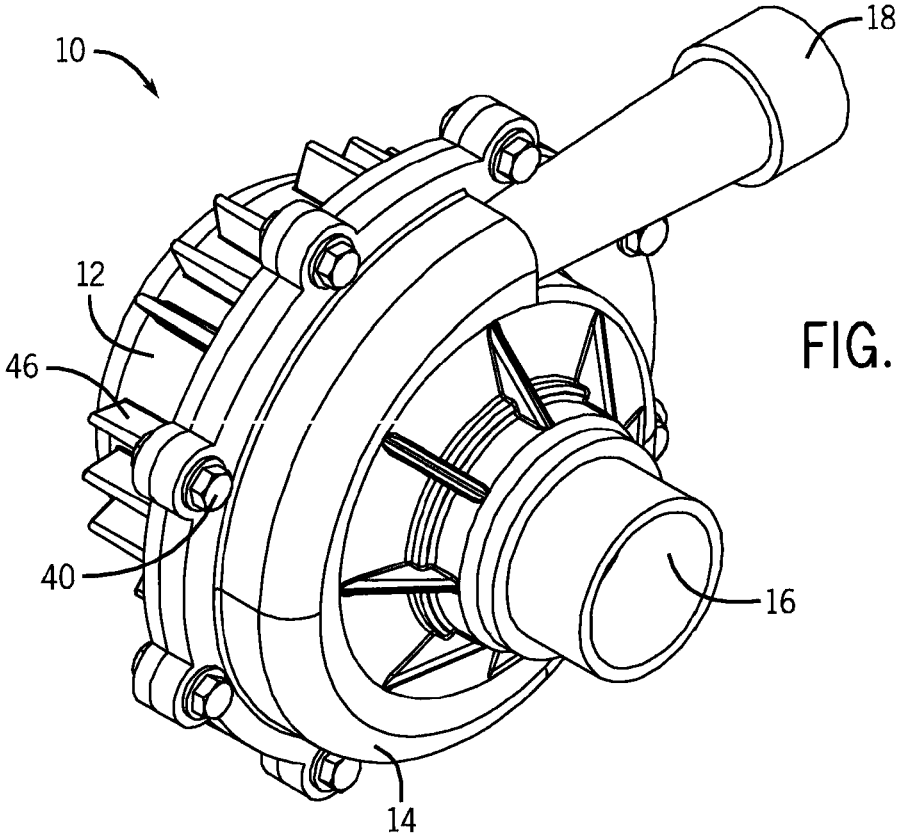
FIG. 4 is a front perspective view of the pump assembly of FIG. 1.
Figure 5:
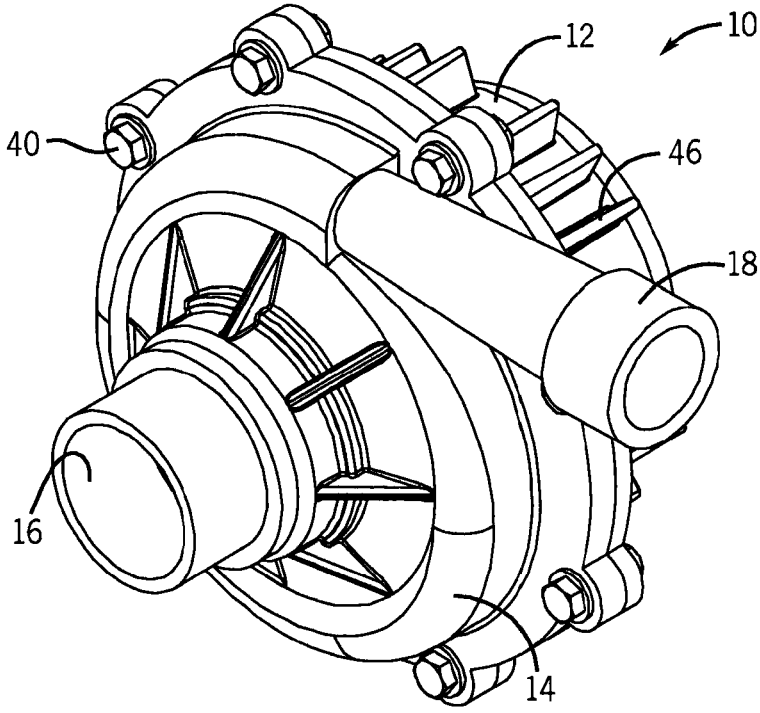
FIG. 5 is another front perspective view of the pump assembly of FIG. 1.
Figure 6:
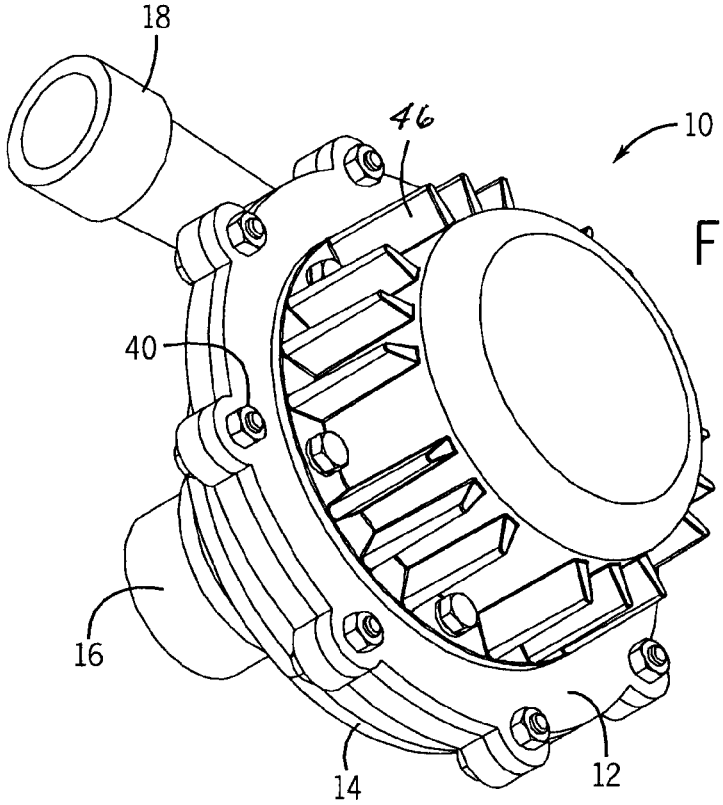
FIG. 6 is a back perspective view of the pump assembly of FIG. 1.
Figure 7:
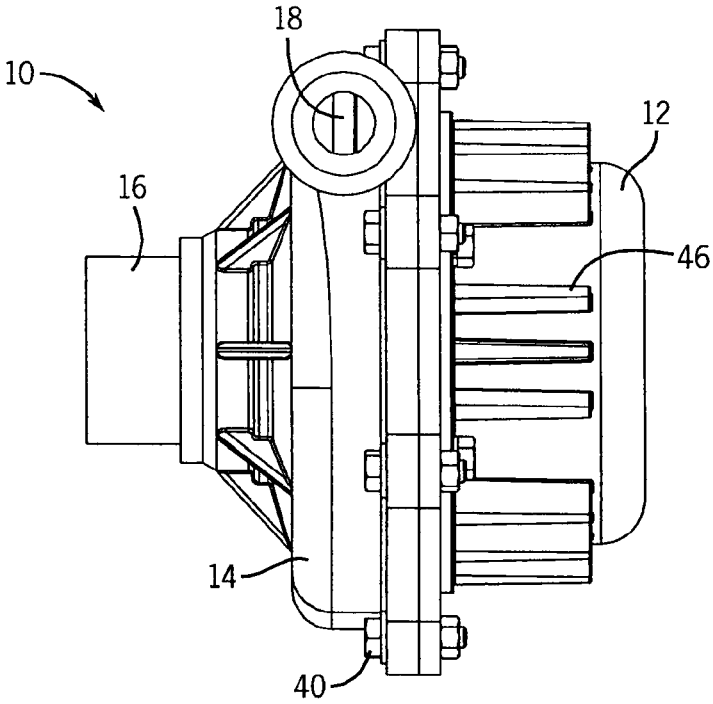
FIG. 7 is a side view of the pump assembly of FIG. 1.

FIGS. 1-7 illustrate a pump assembly 10 according to one embodiment of the invention. The pump assembly 10 can include a lower pump housing 12 (as shown in FIG. 2), an upper pump housing 14, an inlet 16, and an outlet 18. In some embodiments, the pump assembly 10 can be a compact, magnetic drive, centrifugal pump with an integrated motor assembly 20, as shown in FIG. 3. In some embodiments, a diameter of the pump assembly 10 can be about 7.2 inches and a thickness of the pump assembly 10 (i.e., from a top of the inlet 16 to a bottom of the lower pump housing 12) can be about 6.6 inches.

In some embodiments, the pump assembly 10 can be used in various applications, such as agriculture and horticulture, automotive, brewery, cryogenics, dairy, medical, petrochemicals, pharmaceuticals, semiconductor manufacturing, thermal cooling, water treatment, chillers, aquariums, ponds, waterfalls, etc., to pump media such as fresh water, acids, combustible chemicals, corrosive chemicals, effluent, fuel, ground water, coolants, salt water, photochemicals, etc.

In some embodiments, the pump assembly 10 can be used to circulate water or cooling fluid through tubing around small electronics or computer systems (not shown) to permit proper heat dissipation of the electronics or computer systems. The tubing can connect to the inlet 16 and the outlet 18 and the pump assembly 10 can circulate the fluid at about 75 gallons per minute (gpm) with about 40 feet of head pressure, in one embodiment. In addition, the motor assembly 20 can operate using an input voltage of about 400 volts, and the motor assembly 20 can dissipate about 250 kilowatts (kW) of heat while operating using the 400-volt input voltage, in one embodiment.

FIG. 3 illustrates a cross section of the pump assembly 10. As shown in FIG. 3, the motor assembly 20 can include a static shaft 22, a rotor assembly 24, bearings 26, and a stator assembly 28. The rotor assembly 24, which can include a rotor 30 and an impeller 32, can be supported by the static shaft 22 and the bearings 26. The rotor assembly 24 can circumscribe the static shaft 22 and the stator assembly 28 can drive the rotor assembly 24 to rotate about the static shaft 22. In some embodiments, the static shaft 22 and the bearings 26 can include one or more ceramic materials.

The motor assembly 20 can provide an integrated permanent magnet brushless motor within the pump assembly 10. By using the stator assembly 28 instead of a separate drive magnet coupled to an external motor, the pump assembly 10 can be substantially less expensive (e.g., due to of reduced material costs), lighter, quieter, and more compact than conventional pumps. In addition, the pump assembly 10 can have cleaner operation and increased life due to elimination of leakage paths and shaft seals, due to the permanent magnet drive current construction, and due to a reduced number of bearings and mass in motion. This also results in improved efficiency due to reduced power consumption. The pump assembly 10 can also be capable of handling aggressive media successfully, and be more reliable due to better thermal management in comparison to conventional pumps, as further described below.

As shown in FIG. 3, the pump assembly 10 can include a pumping chamber 34 and a motor chamber 36. The pumping chamber 34 can fluidly connect the inlet 16 and the outlet 18. For example, fluid (e.g., water or liquid coolant) can be drawn into the pumping chamber 34 through the inlet 16 and forced out of the pumping chamber 34 through the outlet 18 by rotation of the impeller 32 within the pumping chamber 34. In some embodiments, the rotor 30 and the impeller 32 can be a single integral part or two separate pieces coupled together. In addition, the rotor 30 can be positioned within the motor chamber 36 and the impeller 32 can be positioned within the pumping chamber 34. As shown in FIG. 3, there are no seals between the pumping chamber 34 and the motor chamber 36. As a result, fluid from the pumping chamber 34 can circulate through the motor chamber 36. The circulating fluid can flow in between the static shaft 22 and the bearings 26 and the rotor 30, thus providing lubrication for the bearings 26 and cooling for the motor assembly 20.

The stator assembly 28 can fit inside the lower pump housing 12, and in some embodiments, the inside of the lower pump housing 12 (including the stator assembly 28) can be overmolded with an overmold material 38, such as epoxy, silicone, or a similar material. The rotor assembly 24 can then be placed inside the overmolded lower pump housing 12 (including the stator assembly 28), and the upper pump housing 14 can be placed over the lower pump housing 12. The upper pump housing 14 and the lower pump housing 12 can then be coupled together via fasteners 40 around the pump assembly 10, as shown in FIGS. 1-7. Also, as shown in FIG. 3, the upper pump housing 14 can include a holding portion or holder 42 which can be positioned over and/or around a portion of the static shaft 22 when the upper pump housing 14 is coupled to the lower pump housing 12. The holder 42 can help maintain the position the static shaft 22 within the pump assembly 10 and can also help prevent the static shaft 22 from rotation or lateral movement. In addition, the top bearing 26 can abut the holder 42, as shown in FIG. 3. As a result, the holder 42 can also help prevent axial movement of the rotor assembly 24 along the static shaft 22. In some embodiments, the pump assembly 10 can also include a self-priming channel (not shown) to permit self-priming.

The overmold 38 can provide a liquid-tight seal between the pumping chamber 34 and the stator assembly 28, as well as the motor chamber 36 and the stator assembly 28, thus keeping the stator assembly 28 dry. The overmold 38 being in contact with fluid in both the pumping chamber 34 and the motor chamber 36 can also act as a heat sink for the stator assembly 28. In addition, the overmold 38 provides better heat conducting capabilities than air, allowing heat to be released more rapidly to the circulating fluid in the pumping chamber 34 and the motor chamber 36 than in conventional pumps where the stator is surrounded by air. Thus, the overmold 38 can be a one-piece overmold that can isolate the stator assembly 28 from fluid and act as a heat sink for the stator assembly 28.

The overmold 38 can also provide high dielectric strength between windings 44 of the stator assembly 28 and the fluid in the motor chamber 36, helping prevent leakage currents. The high dielectric strength and enhanced thermal transfer capabilities of the overmold 38 can allow the motor assembly 20 to operate at higher voltages than conventional pumps. The higher input voltage can permit the pump assembly 10 to operate at a faster speed, increasing the flow rate of the fluid being pumped compared to conventional pumps. The higher input voltage can also permit increased loads on the motor assembly 20, reducing the risk of the motor assembly 20 falling out of synchronization due to over-loading. As a result, the pump assembly 20 can handle aggressive media better than conventional pumps with similar proportions. The overmold 38 can also provide an improved magnetic field around the motor assembly 20, compared to conventional pumps with air gaps between the stator assembly 28 and the rotor assembly 24. In addition, metals are prone to eddy currents in environments with a varying magnetic field. Thus, conventional induction-type motors with metal cans, which use a metallic separator between the rotor and the stator, generate additional heat inside of the motor due to the eddy currents. The overmold 38, because it is not a metallic material, can reduce the risk of generated eddy currents within the pump assembly 10.

Figure 8:
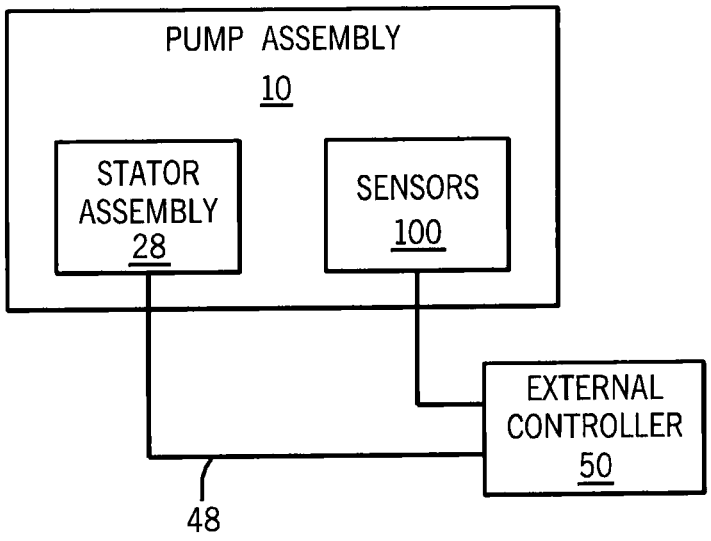
FIG. 8 is a schematic view of a pump assembly according to one embodiment of the invention.

In some embodiments, the lower pump housing 12 can be made of stainless steel and can also act as a heat sink for the motor assembly 20 (e.g., to surrounding outside air). Also, in some embodiments, the lower pump housing 12 can include fins 46 around its outside, as shown in FIGS. 1 and 3-6. The fins 46 can provide additional surface area for effective heat transfer from the lower pump housing 12. Also, electrical connectors or lead wires 48 (as shown schematically in FIG. 8) connected to the stator assembly 28 can be provided through one or more of the fins 44 or another bottom portion of the lower pump housing 12. The lead wires 48 can electrically connect the stator assembly 28 to a controller 50, as shown in FIG. 8, which can control operation of the pump assembly 10 (i.e., by providing power to, adjusting power to, and/or removing power from the stator assembly 28). The overmold 38 can completely isolate the lead wires 48 from fluid being pumped. In some embodiments, the controller 50 can be an external controller, as shown in FIG. 8. For example, the controller 50 can be completely separate from the pump assembly 10 or the controller 50 can be mounted to a rear or outside portion of the pump assembly 10. In other embodiments, the controller 50 can be an internal controller positioned inside the pump assembly 10 (for example, sealed from the fluid by the overmold 38). In embodiments where the controller 50 is mounted on the pump assembly 10 or positioned inside the pump assembly 10, the lower pump housing 12, the upper pump housing 14, and/or the overmold 38 can act as heat sinks to help cool the controller 50.

Figure 9:
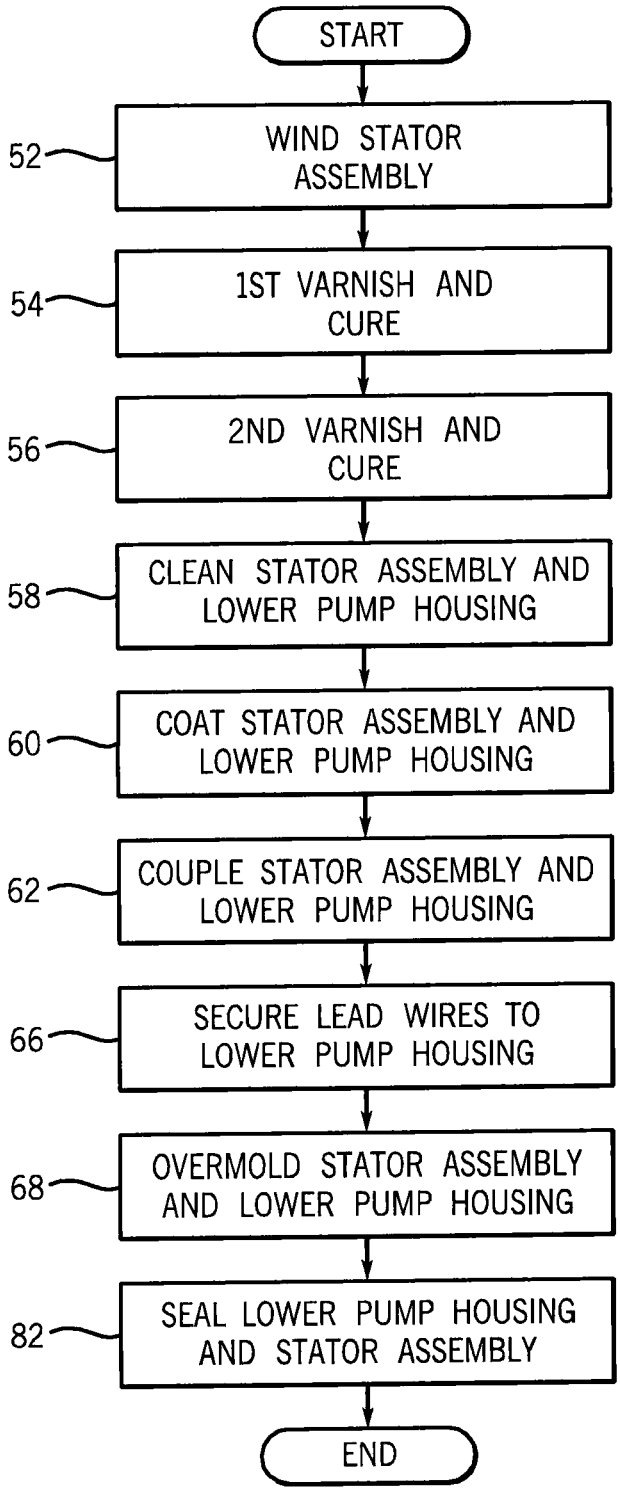
FIG. 9 is a flow diagram of a process for assembling a lower pump housing and a stator assembly of the pump assembly of FIG. 1.
Figure 10:
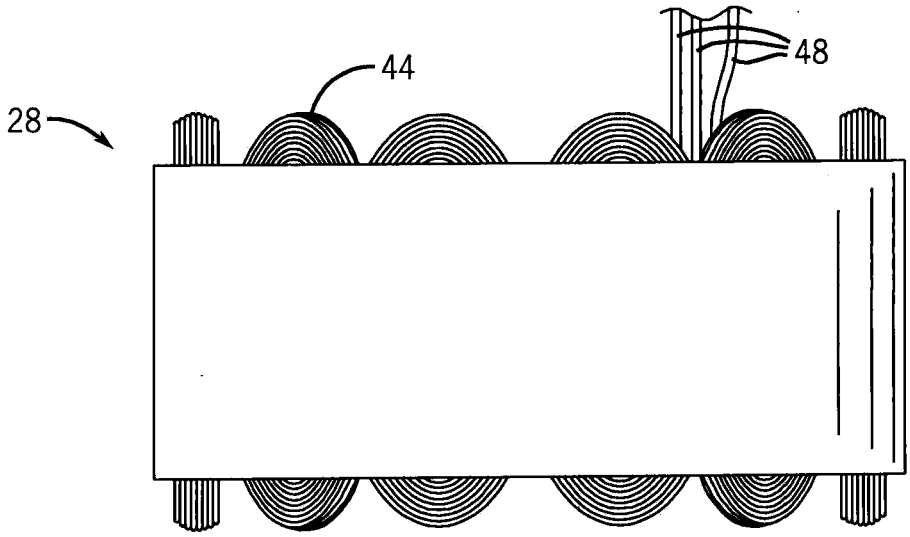
FIG. 10 is a front view of a stator assembly during the assembly process of FIG. 9.
Figure 11:
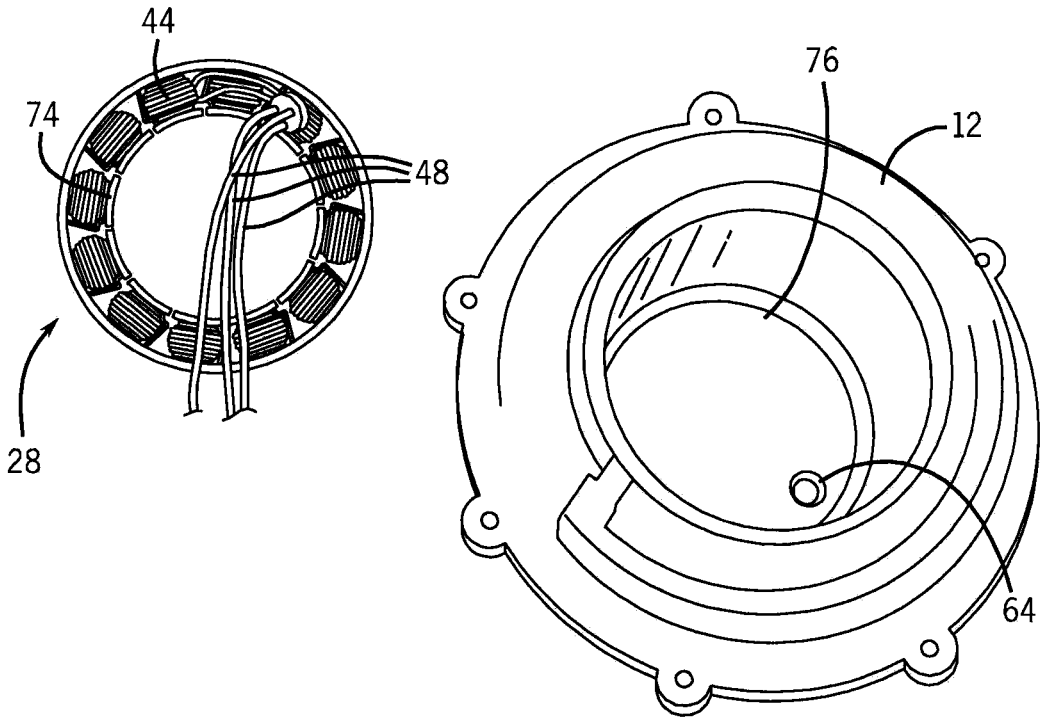
FIG. 11 is a perspective top view of a stator assembly and a lower pump housing during the assembly process of FIG. 9.

FIG. 9 illustrates an assembly process for manufacturing the stator assembly 28 and the lower pump housing 12 according to one embodiment of the invention. First, at step 52, the stator assembly 28 can be wound using wire including, for example, a dielectric strength of about 4275 volts/millimeter (e.g., Aspen Motion Technologies Part No. 10039). Then, at step 54, the stator assembly 28 can be dipped in a varnish with, for example, a dielectric strength of about 1300 volts/millimeter when wet and about 2500 volts/millimeter when dry (e.g., Aspen Motion Technologies Part No. 10912). The stator assembly 28 can be placed in an oven to cure after excess varnish has been drained from the stator assembly 28. At step 56, the stator assembly 28 can be dipped in varnish for a second time and placed in the oven to cure. FIG. 10 illustrates the cured stator assembly 28 according to one embodiment of the invention. In addition, as shown in FIGS. 10 and 11, the lead wires 48 can be coupled to the stator assembly 28. The lead wires 48 can electrically connect the stator assembly 28 to the controller 50, as shown in FIG. 8.

Figure 12A:
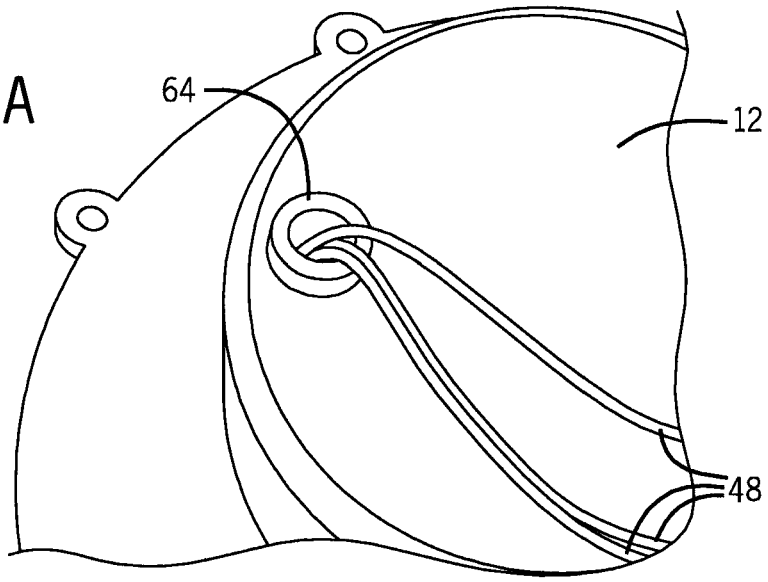
FIG. 12A is a bottom view of a lower pump housing during the assembly process of FIG. 9.
Figure 12B:
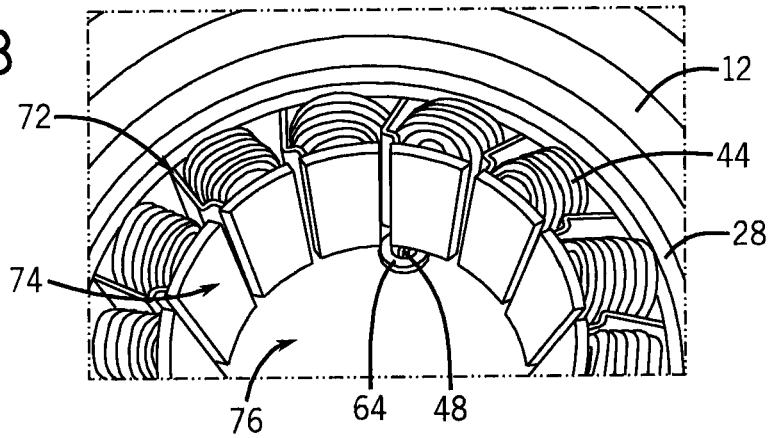
FIG. 12B is an inside view of a pump housing and a stator assembly during the assembly process of FIG. 9.

As step 58, the stator assembly 28 and at least an inner portion of the lower pump housing 12, as shown in FIG. 11, can be cleaned with alcohol and allowed to dry. At step 60, the stator assembly 28 can be coated with an adhesive (e.g., Aspen Motion Technologies Part No. 10903 "Loctite 325" adhesive) and the inner portion of the lower pump housing 12 can be coated with an activator (e.g., Aspen Motion Technologies Part No. 10904 "Loctite 7380" activator). For example, a bottom portion and an outer circumference portion of the stator assembly 28 can be coated with the adhesive (i.e., portions which will come into contact with the lower pump housing 12), and an inner circumference portion and part of an inside bottom portion of the lower pump housing 12 can be coated with the activator (i.e., portions which will come into contact with the stator assembly 28). At step 62, the stator assembly 28 can be placed inside the inner portion of the lower pump housing 12, joining the adhesive and the activator. As shown in FIGS. 12A and 12B, the lead wires 48 can be routed through a wire grommet 64 of the lower pump housing 12 when the stator assembly 28 is placed inside the lower pump housing 12. The adhesive can be allowed to cure in order to couple together the stator assembly 28 and the lower pump housing 12.

Figure 12C:
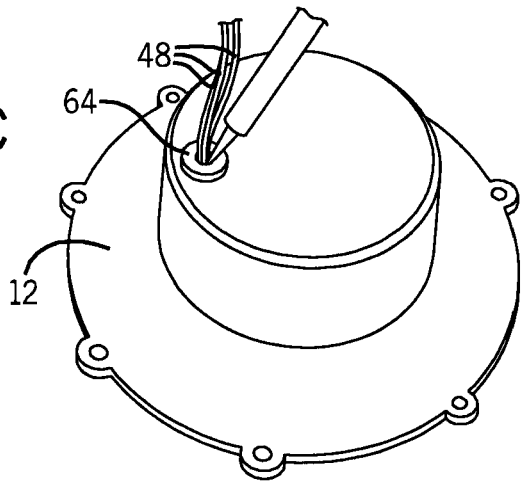
FIG. 12C is another bottom view of a lower pump housing during the assembly process of FIG. 9.

At step 66, the lead wires 48 can be secured to the combined stator assembly 28 and lower pump housing 12. The lead wires 48 can be bonded in place through the wire grommet 64 using an epoxy (e.g., Aspen Motion Technologies Part No. 11490), as shown in FIG. 12C, and allowed to cure.

At step 68, a mold insert 70, as shown in FIG. 13, can be placed inside the lower pump housing 12 over the stator assembly 28 and the overmold material 38 (e.g., Aspen Motion Technologies Part No. R45-14701) can be transfer-molded around the insert 70 over an exposed portion of the stator assembly 28 and the lower pump housing 12. More specifically, as shown in FIG. 12B, a top portion 72 and an inner circumference 74 of the stator assembly 28 can be overmolded with the overmold material 38, and an inside bottom portion 76 of the lower pump housing 12 can be overmolded with the overmold material 38. The insert 70 can be constructed so that the overmold 38 has a varied thickness (e.g., from about 0.01 inch to about 0.1 inch). The overmolded lower pump housing 12 can be removed from the mold insert 70 when the overmold 38 is cool.

As shown in FIG. 13, the insert 70 can include grooves 78. The grooves 78 can translate to the overmold 38, providing complimentary grooves 80, as shown in FIGS. 3 and 14A, for holding the static shaft 22 and the lower bearing 26 in their correct positions when the motor assembly 20 is placed inside the lower pump housing 12. More specifically, the complimentary grooves 80 can substantially prevent the static shaft 22 from lateral movement within the lower pump housing 12. In addition, the insert 70 can include protrusions (not shown), which translate to the overmold 30, to provide fluid pathways between the pumping chamber 34 and the motor chamber 36 when the pump assembly 10 is assembled.

At step 82, an interface between the lower pump housing 12 and the stator assembly 28 can be sealed. In one embodiment, the lower pump housing 12 and the stator assembly 28 can be coated with an adhesion promoter (e.g., Aspen Motion Technologies Part No. 15660 "Dow Corning P5200 adhesion promoter"), allowed to cure, and then an exposed interface 84 between the stator assembly 28 and the lower pump housing 12 can be sealed with a potting compound (e.g., Aspen Motion Technologies Part No. 12136 "Dow Corning Sylhard 160 Potting Compound"), as shown in FIGS. 14A and 14B.

Figure 15:
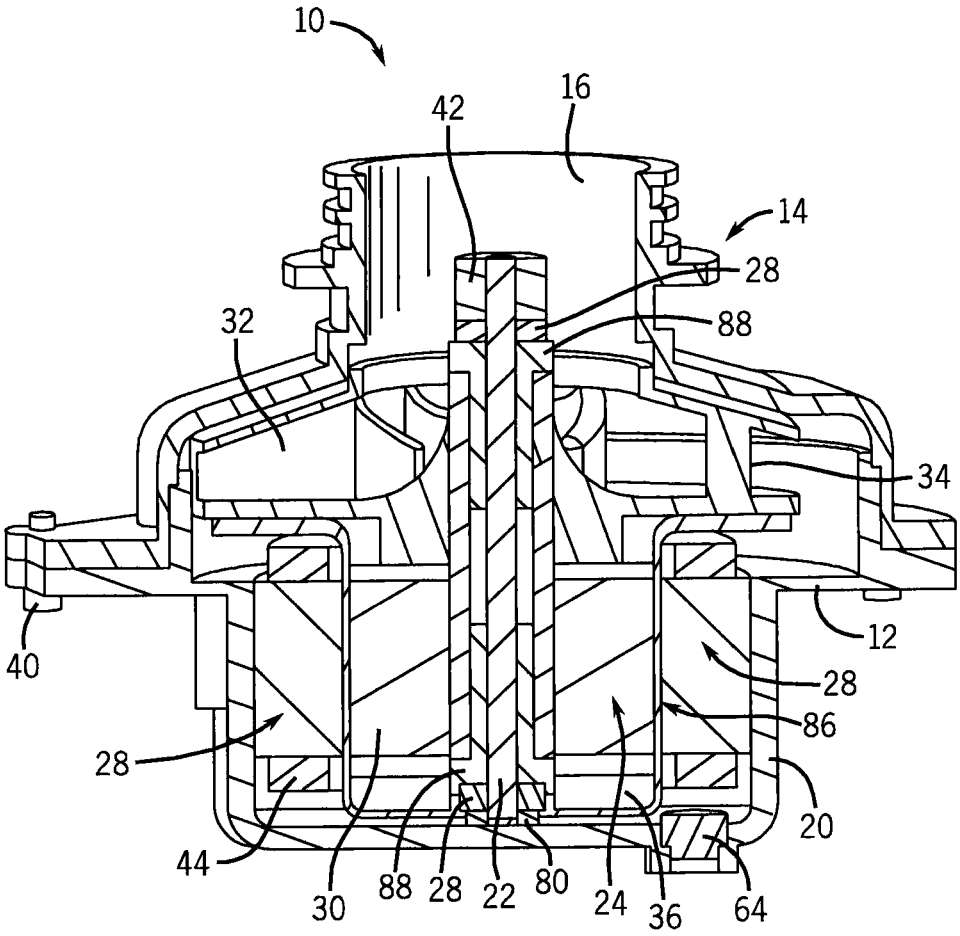
FIG. 15 is a cross-sectional view of a pump assembly according to another embodiment of the invention.

In some embodiments, as shown in FIG. 15, the pump assembly 10 can include an isolation cup 86. The isolation cup 86 can separate the overmolded lower pump housing 12 from the pumping chamber 34 and the motor chamber 36. As a result, the stator assembly 28, as well as the overmold 38, can be kept dry, preventing the overmold 38 from absorbing water. In some embodiments, the isolation cup 86 can also provide additional structural strength to the overmolded lower pump housing assembly 12. The overmold 38, through the isolation cup 86, can continue to provide enhanced dielectric strength and help remove heat from the stator assembly 28. In addition, the impeller 32 and the isolation cup 86 can be positioned relative to each other within the pump assembly 10 to allow fluid to flow from the pumping chamber 34 into the motor chamber 36. In some embodiments, the isolation cup 86 can be constructed of Polyether Ether Ketone (PEEK) or a similar moldable material.

The isolation cup 86 can include the complimentary grooves 80, as shown in FIG. 15, for holding the static shaft 22 and the lower bearing 26 in their correct positions when the motor assembly 20 is placed inside the lower pump housing 12, substantially preventing the static shaft 22 from moving within the lower pump housing 12. In addition, in some embodiments, as shown in FIG. 15, the pump assembly 10 can also include spacers 88 (e.g., ceramic spacers) surrounding the static shaft 22 and the rotor assembly 24 can rotate about the spacers 88.

Figure 16:
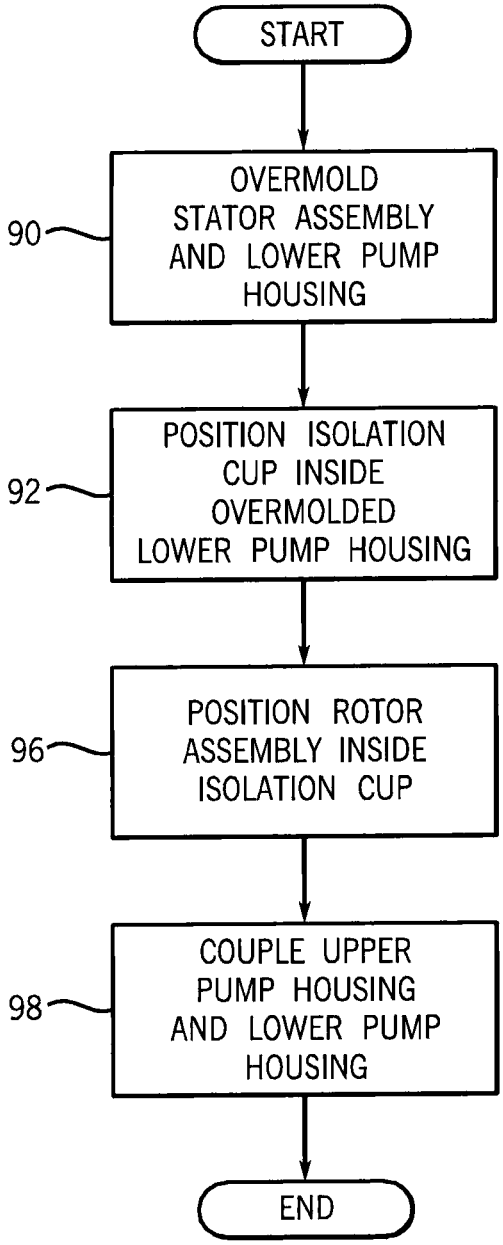
FIG. 16 is a flow diagram of a process for assembling a lower pump housing and a stator assembly of the pump assembly of FIG. 15.
Figure 17A:
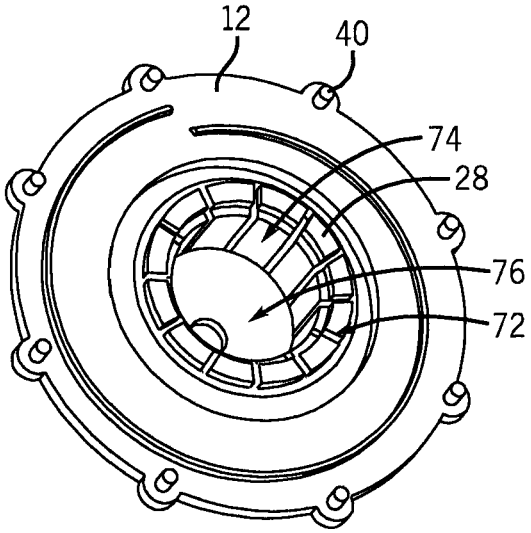
FIGS. 17A-17D are perspective views of pump assembly components during the assembly process of FIG. 16.
Figure 17C:
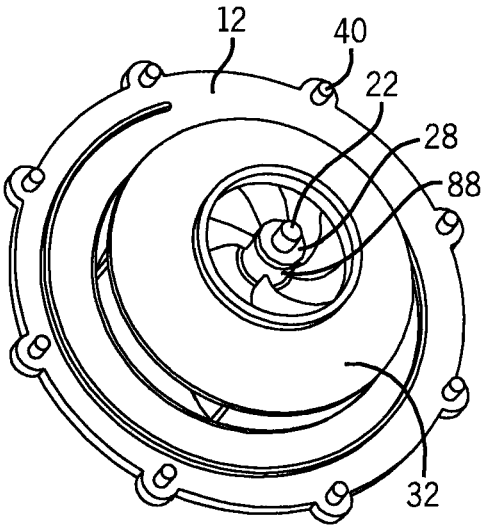
Figure 17B:
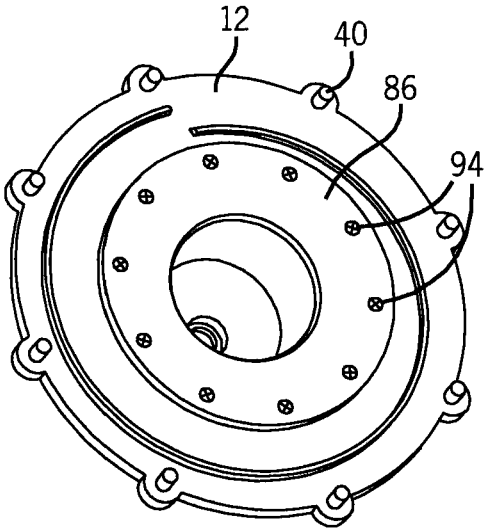
Figure 17D:
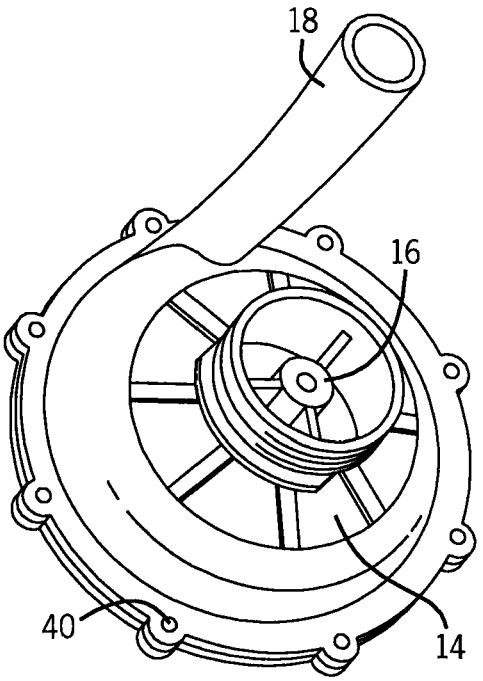

FIG. 16 illustrates an assembly process for manufacturing the pump assembly 10 according to another embodiment of the invention. At step 90, the stator assembly 28 can be positioned inside the lower pump housing 12, as shown in FIG. 17A, and the inside of the stator assembly 28 and the lower pump housing can be overmolded with the overmold material 38 (as described above). At step 92, the isolation cup 86 can be positioned inside the overmolded lower pump housing 12. In some embodiments, the isolation cup 86 can be coupled to the lower pump housing 12 by fasteners 94, as shown in FIG. 17B. In addition, in some embodiments, an exposed interface between the isolation cup 86 and the lower pump housing 12 can be sealed (e.g., with a potting compound). At step 96, the rotor assembly 24 can be positioned inside the isolation cup 86, as shown in FIG. 17C. At step 98, the upper pump housing 14 can be placed over the lower pump housing 12, as shown in FIG. 17D, and the upper pump housing 14 and the lower pump housing 12 can be coupled together by the fasteners 40 around the outside of the pump assembly 10.

As described above, the fluid being pumped by the pump assembly 10 can lubricate the bearings 26 associated with the pump assembly 10 as well as help dissipate heat generated from the stator assembly 28. In some embodiments, the pump assembly 10 can include additional features to prevent or minimize operation of the pump assembly 10 when no fluid is present, as described below.

In some embodiments, the pump assembly 10 can include one or more internal or external sensors 100 (e.g., pressure sensors, force sensors, temperature sensors, and/or current sensors) to monitor dynamic operation of the pump assembly 10, as shown schematically in FIG. 8. For example, one or more pressure sensors can be used to monitor pressure inside the pumping chamber 34, as pressure will be greater when the pump assembly 10 is pumping fluid compared to air. One or more force sensors can be used to measure any force changes associated with the static shaft 22 (e.g., by positioning the force sensor on the static shaft 22 near the impeller 32), as a greater axial force can be exerted on the static shaft 22 when the pump assembly 10 is pumping fluid compared to air. One or more temperature sensors can be used to measure a temperature of the pump assembly 10. The temperature sensors can detect the difference between pump operation with and without fluid because fluid present improves the pump assembly's ability to dissipate heat from the stator assembly 28. Thus, an increase in temperature can indicate minimal or no fluid is being pumped. A current sensor can be used to measure current draw characteristics associated with the motor assembly 20. For example, current draw associated with the motor assembly 20 can directly correspond to the amount of torque required to rotate the impeller. The current sensor can be used to help detect a wet pump assembly 10 or a dry pump assembly 10 because pumping fluid will require more torque on the rotor assembly 24 to turn at a given speed when compared to pumping air.

One or more of the above-mentioned sensors 100 can be in communication with the controller 50, as schematically shown in FIG. 8, and can be dynamically monitored via software of the controller 50. In some embodiments, as long as the dynamic feedback provided from the sensors 100 provides a signal or signal range indicating the pump assembly 10 is operating wet (i.e., with fluid present), the controller 50 can allow the pump assembly 10 to continue to operate (i.e., continue providing power to the stator assembly 28). If the feedback provided reflects dry operation of the pump assembly 10 (i.e., when no fluid is being pumped), the controller 50 can remove power to the stator assembly 28, stopping operation of the pump assembly 10. In some embodiments, the sensors 100 (e.g., the pressure sensors) can be micro-electro-mechanical system (MEMS) based sensors. The controller 50, in conjunction with the integrated motor assembly 20, can provide improved controllability and throttle ability of the pump assembly 10 because the motor speed and/or the torque of the motor assembly 20 can be varied quickly and easily by the controller 50. Adding one or more of the sensors 100 as part of a control loop for the pump assembly 10 can further improve the controllability and throttle ability due to faster, dynamic monitoring of torque, motor speed, and/or other motor assembly characteristics.

To more accurately determine if the pump assembly 10 is attempting to operate without fluid, a combination of one or more of the above-mentioned sensors 100 can be used in some embodiments. The sensors 100 can be calibrated during normal operation of the pump assembly 10 to determine normal operating conditions. In some embodiments, the controller 50 can include pre-set operating conditions for each of the sensors 100 in a wet environment (i.e., a loaded environment, with fluid being pumped) and a dry environment (i.e., an unloaded environment, without fluid being pumped). In addition, the controller 50 can include sensing algorithms specific to each sensor 100. For example, temperature measurements can require the pump assembly 10 to have operated for a period of time before the temperature change is measurable. As a result, the controller 50 can rely on temperature sensor measurements only after the time period has exceeded. In another example, as a pump assembly 10 ages and the bearings 26 wear, dynamics such as torque requirements can change. As a result, to prevent unnecessary shut-downs from current sensing, the controller 50 can require or automatically perform recalibration of the current sensor after a certain time period.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A pump assembly for pumping a fluid, the pump assembly comprising:

a first pump housing;

a second pump housing removably coupled to the first pump housing;

a motor assembly including a rotor assembly and a stator assembly, the stator assembly positioned inside the first pump housing, and the rotor assembly including a rotor and an impeller;

an overmold covering the stator assembly and an inside portion of the first pump housing;

a static shaft and a pair of axially spaced bearings for mounting the rotor assembly on the static shaft for rotation about the static shaft; and an isolation cup positioned inside the first pump housing and coupled to the first pump housing, the rotor assembly positioned inside the isolation cup, wherein the isolation cup is arranged and configured to provide a fluid seal between the overmold and the rotor assembly, wherein the isolation cup includes a groove for holding one of the pair of bearings in a correct position.

2. The pump assembly of claim 1 and further comprising a controller to one of apply power to and remove power from the stator assembly, wherein applying power to the stator assembly causes the rotor assembly to rotate about the static shaft.

3. The pump assembly of claim 2 wherein the controller is electrically coupled to the stator assembly by lead wires.

4. The pump assembly of claim 1, wherein the impeller is integral with the rotor.

5. The pump assembly of claim 1, wherein the second pump housing includes a pump inlet and a pump outlet.

6. The pump assembly of claim 5, wherein the pump inlet and the pump outlet project along non-parallel axes.

7. The pump assembly of claim 1 and further comprising a pumping chamber surrounding the impeller, and a motor chamber surrounding the rotor and in fluid communication with the pumping chamber.

8. The pump assembly of claim 1 wherein the static shaft and the pair of bearings are ceramic.

9. The pump assembly of claim 2 and further comprising at least one sensor sensing one of pressure, force, temperature, and current, wherein the sensor provides a signal to the controller indicating whether the pump is operating in a dry condition without the intended fluid to be pumped, and the controller is configured to remove power from the stator assembly when the dry condition is indicated.

10. The pump assembly of claim 1 wherein the overmold and the isolation cup prevent the fluid from contacting the stator assembly and transfer heat generated by the stator assembly to the fluid.

11. A method of assembling a pump assembly, the method comprising:

coupling a stator assembly to a lower pump housing;

overmolding an overmold material over an inside portion of the stator assembly and an inside portion of the lower pump housing;

positioning an isolation cup inside the lower pump housing over the overmold material, wherein the isolation cup includes grooves for positioning a bearing and a static shaft;

positioning a rotor assembly at least partially inside the isolation cup, wherein the isolation cup is arranged and configured to provide a fluid seal between the overmold and the rotor assembly, and wherein the grooves of the isolation cup position a static shaft and a bearing supporting the rotor assembly for rotation about the static shaft;

securing a position of the rotor assembly by placing an upper pump housing over the rotor assembly; and coupling the upper pump housing to the lower pump housing.

12. The method of claim 11 and further comprising coupling the isolation cup to the lower pump housing.

13. The method of claim 11 and further comprising sealing an interface between the stator assembly and the lower pump housing.

14. The method of claim 11 and further comprising connecting lead wires from the stator assembly to a controller.

15. The method of claim 11 wherein coupling the stator assembly to the lower pump housing includes using an adhesive and an activator.

16. The method of claim 11 wherein overmolding the overmold material over the inside portion of the stator assembly and the inside portion of the lower pump housing includes placing a mold insert over the stator assembly and transfer-molding the overmold material.

17. The pump assembly of claim 1 wherein the pair of bearings are fitted with respect to the static shaft to enable the fluid to flow between the static shaft and the pair of bearings.

18. The pump assembly of claim 1 wherein the stator assembly and the impeller are at axial locations along the static shaft between the pair of bearings.

19. The pump assembly of claim 1 wherein the impeller is positioned inside the second pump housing.

20. A pump assembly for pumping a fluid, the pump assembly comprising:

a first pump housing;

a second pump housing removably coupled to the first pump housing;

a motor assembly including a rotor assembly and a stator assembly, the stator assembly positioned inside the first pump housing, and the rotor assembly including a rotor and an impeller;

an overmold covering the stator assembly and an inside portion of the first pump housing; and a static shaft and a pair of axially spaced bearings for mounting the rotor assembly on the static shaft for rotation about the static shaft, wherein the stator assembly and the impeller are at axial locations along the static shaft between the pair of bearings.

* * * * *